United States Patent [19]

Larry

[11] 4,101,708

[45] Jul. 18, 1978

[54] RESISTOR COMPOSITIONS

[75] Inventor: John Robert Larry, Youngstown, N.Y.

[73] Assignee: E. I. Du Pont de Nemours and Company, Wilmington, Del.

[21] Appl. No.: 781,310

[22] Filed: Mar. 25, 1977

[51] Int. Cl.[2] ..... H01B 1/08

[52] U.S. Cl. ..... 428/432; 252/518; 252/521

[58] Field of Search ..... 252/518, 521; 428/432

[56] References Cited

U.S. PATENT DOCUMENTS

| | | | |
|---|---|---|---|
| 3,304,199 | 2/1967 | Faber, Sr. et al. | 252/521 X |
| 3,352,797 | 11/1967 | Kim | 252/518 X |
| 3,637,530 | 1/1972 | Casale et al. | 252/518 |
| 3,679,607 | 7/1972 | Angus et al. | 252/518 |
| 3,776,772 | 12/1973 | Asada et al. | 252/514 X |
| 3,778,389 | 12/1973 | Kasanami et al. | 252/520 |
| 3,868,334 | 2/1975 | Van Loan | 252/518 X |

*Primary Examiner*—Benjamin R. Padgett
*Assistant Examiner*—E. Suzanne Parr

[57] ABSTRACT

Resistor compositions of inorganic powders dispersed in an inert vehicle, for making film resistors on dielectric substrates. The powders comprise certain proportions of $RuO_2$, PbO-containing glass, $Nb_2O_5$ and, optionally, $CaF_2$. Also sintered resistors thereof adherent to such substrates.

10 Claims, No Drawings

RESISTOR COMPOSITIONS

BACKGROUND OF THE INVENTION

This invention relates to electronics, and more particularly to compositions useful for producing resistor patterns adherent to substrates.

Resistor compositions which are applied to and fired on dielectric substrates (glass, glass-ceramic, and ceramic) usually comprise finely divided inorganic powders (e.g., metal and/or oxide particles and inorganic binder particles) and are commonly applied to substrates using so-called "thick film" techniques, as a dispersion of these inorganic powders in an inert liquid medium or vehicle. Upon firing or sintering of the film, the metallic and/or oxide component of the composition provides the functional (conductive) utility, while the inorganic binder (e.g., glass, crystalline oxides such as $Bi_2O_3$, etc.) bonds the metal particles to one another and to the substrate. Thick film techniques are contrasted with thin film techniques which involve deposition of particles by evaporation or sputtering. Thick film techniques are discussed in "Handbook of Materials and Processes for Electronics," C. A. Harper, Editor, McGraw-Hill, N.Y., 1970, Chapter 12.

Numerous patents disclose the compositions of pyrochlore related oxides of the general formula $A_2B_2O_{6-7}$, plus glass binder, dispersed in a vehicle, and for printing and firing to produce resistor films. Such patents include Bouchard U.S. Pat. No. 3,583,931, Hoffman U.S. Pat. No. 3,553,109 and Bouchard et al. U.S. Pat. No. 3,896,055, each of which is incorporated by reference herein.

Faber et al. U.S. Pat. No. 3,304,199 discloses resistor compositions of the rutile $RuO_2$ plus glass, and is also incorporated by reference herein.

Casale et al. U.S. Pat. No. 3,637,530 teaches resistor compositions comprising a single phase (col. 2, line 64) reaction product of certain proportions of niobium pentoxide and ruthenium dioxide, plus glass, dispersed in a vehicle. It is disclosed that the presence of unreacted niobium pentoxide is extremely harmful (col. 2, line 66) to achieving patentee's desired results. Lead borosilicate glass is disclosed in Example 2 but no compositional limits are mentioned. The $Nb_2O_5/RuO_2$ product of Casale et al. is formed by preheating the reactants at temperatures not less than 1000° C. (col. 2, line 56).

There is a need for resistor compositions capable of producing fired resistor films which can exhibit reduced difference (spread) between hot and cold temperature coefficient of resistance (TCR), i.e., 0±250 ppm/° C., preferably 0±100 ppm/° C., and yet have a low coefficient of variation in resistivity.

SUMMARY OF THE INVENTION

This invention provides printable compositions which are dispersions of finely divided (−400 mesh, U.S. standard scale) inorganic powder dispersed in an inert liquid vehicle. The compositions are useful for producing sintered film resistors adherent to dielectric substrates. The compositions consist essentially of the materials indicated below, all percentages being by weight:

| Powder | Operative | Preferred | Optimum |
|---|---|---|---|
| $RuO_2$ | 2–45 | 3–30 | 4–20 |
| Glass | 40–70 | 45–65 | 47–62 |

-continued

| Powder | Operative | Preferred | Optimum |
|---|---|---|---|
| $Nb_2O_5$ | 0.1–0.8 | 0.2–0.7 | 0.2–0.7 |
| $CaF_2$ | 0–5 | 0–5 | 1–3 |
| Vehicle | 15–40 | 20–40 | 20–10 |

The glass comprises 30–55% PbO, preferably 40–45% PbO. The resultant sintered resistors are also a part of this invention.

DETAILED DESCRIPTION

The present invention provides compositions which comprise $RuO_2$ and $Nb_2O_5$, but have the advantage that $RuO_2$ and $Nb_2O_5$ need not be prefired at 1000° C. as required by Casale et al.

The TCR characteristics of fired films produced according to this invention are reproducible. Specific TCR properties obtained are dependent on the compositions selected, but absolute TCR values ("hot" TCR, measured between +25° and +125° C. and "cold" TCR measured between −55° and +25° C.) can be 0±250 ppm/° C., normally 0±100 ppm/° C. for preferred compositions, even as low as 0±50 ppm/° C. Also, the difference between hot and cold TCR (ΔTCR) can be within 100 ppm/° C. for each composition. As indicated in Table 3, these compositions can also produce fired film which exhibit reduced variation of resistivity with length of resistor, a distinct processing advantage, and CVR's of 8% or less.

The compositions of this invention comprise the above-stated proportions of $RuO_2$, $Nb_2O_5$, PbO-containing glass and vehicle. $CaF_2$ is optional.

At least 2% $RuO_2$ is present in the compositions to provide adequate conductivity, but no more than 45% $RuO_2$ is present to permit adequate amounts of glass binder and hence good adhesion. Preferred amounts of $RuO_2$ are 3–30%, more preferably 4–20%. Instead of $RuO_2$, hydrates of $RuO_2$ may be used (e.g., $RuO_2.3H_2O$), in amounts to produce to the stated amounts of $RuO_2$.

At least 0.1% $Nb_2O_5$ is present to reduce TCR spread, but no more than 0.8% is present since TCR would be adversely affected by larger amounts. Preferably 0.2–0.7% $Nb_2O_5$ is present.

$CaF_2$ serves to make resistivity less dependent on resistor length. $CaF_2$ is optional, but normally no more than 5% $CaF_2$ is present to preclude significant alteration in resistivity and TCR. Preferably 1–3% $CaF_2$ is present.

The glass serves to bind the conductive particles to one another and to the substrate. The glass comprises 30–55% PbO, preferably 40–45% PbO. More than 55% PbO in the glass reduces stability against humidity and makes it more susceptible to changes under reducing conditions. At least 30% lead oxide is used to control glass viscosity and hence the coefficient of variation in resistivity. The amount of PbO-containing glass in the composition is 40–70%, preferably 45–65%, more preferably 47–62%, of the composition. Less than 40% glass reduces adhesion; more than 70% glass causes too high resistivity. Other conventional glass constituents, such as $B_2O_3$, $SiO_2$ and/or $Al_2O_3$, are also present in the glass.

The relative quantities of the above inorganic materials are selected interdependently from the above ranges according to principles well known in the thick film art to achieve desired fired film properties. The compositions may be modified by the addition of small quantities of other materials which do not affect the properties produced by this invention.

The vehicle in the composition is conventional, (solvents viscosified by polymers) and is present as 15–40% of the composition, preferably 20–40%, to provide adequate printing characteristics. Such conventional vehicles are described in Patterson U.S. Pat. No. 3,943,168, issued Mar. 9, 1976, incorporated by reference herein.

The components of these compositions are mixed together conventionally (e.g., in a roll mill) to form a dispersion, and may be printed on a substrate through a screen using conventional technology. Conventional substrates such as prefired alumina are normally used. The printed substrates are then normally dried to remove the more volatile vehicle constituents (e.g., at 100°–150° C. for about 10 minutes), and are then fired to drive off the polymeric viscosifier in the vehicle and to sinter the inorganic constituents into a chemically and physically continuous coating adherent to the substrate. Firing is preferably at a temperature in the range 800°–900° C., more preferably at about 850° C., for at least 5 minutes, preferably about 10 minutes, at peak temperature. Box or belt furnaces may be used. Firing is conducted in air.

EXAMPLES

The following examples and comparative showings are presented to illustrate the scope of this invention. In the examples and elsewhere in the specification and claims all parts, percentages, and ratios are by weight, unless otherwise stated.

All of the inorganic materials used in these experiments had an average particle size in the range 0.2–8 microns, with substantially no particles larger than 15 microns. The approximate surface areas of the glasses used in Tables 2, 3 and 5 are indicated in Table 1. The surface area of the $RuO_2$ used is indicated in each example, of $CaF_2$ 2.8m$^2$/g., and of $Nb_2O_5$ 6.5 m$^2$/g. Conventional vehicles were used, such as 1 part ethyl cellulose in 9 parts of a mixture of terpineol and dibutyl carbitol. Tridecyl phosphate wetting agent was used in some vehicles.

After the inorganic solids and vehicle were thoroughly mixed by conventional roll milling techniques, the resultant dispersion was printed on prefired Pd/Ag terminations of an alumina substrate through a patterned 200-mesh screen. The resistor dimensions were generally 1.5 mils square (about 38 microns). The print was dried at about 150° C. for 10 minutes to dried print about 1 mil (25 microns) thick. The dried print was fired in a conventional belt furnace over a 60 minute cycle with about 10 minutes at a peak temperature of about 850° C. The fired print had a thickness of about 0.5 mil (12–13 microns).

Resistivity was determined using a Non-Linear Systems 8-range ohmmeter Series X-1 and is reported for a square resistor. Temperature coefficient of resistance (TCR), generally expressed in parts per million per degree centigrade, is an important characteristic of resistors since changes in temperature will create relatively large changes in resistance when TCR is high. TCR is determined by measuring resistance of a given resistor at −55°, 25°, and 125° C. The change in resistance is expressed as a function of the room temperature resistance, divided by the temperature increase as follows:

$$TCR = \frac{R_{Ref.\ temp.} - R_{25°\ C.}}{R_{25°\ C.}(T_{ref.temp} - 25°\ C.)} \times 10^6$$

Coefficient of variation in resistivity (CVR) is the measure of the ability to reproducibly achieve a given resistivity during manufacture. Coefficient of variation in resistivity (CVR) was determined using the general formula for coefficient of variation in a set of values, i.e., standard deviation divided by average value, times 100, where standard deviation (sigma) is as follows:

$$\text{sigma} = \left[\frac{\Sigma (x_i - \bar{x})^2}{N - 1}\right]^{\frac{1}{2}}$$

where $x_i$ is the value of a resistor within the measured set of resistors, $\bar{x}$ is the average value for a set of resistors, and $N$ is the number of resistors measured.

Table 1 sets forth the glass used in the compositions of Tables 2, 3 and 5. Using the compositions set forth in Tables 2–5 the properties set forth in the Tables were found.

The $RuO_2$ of Showings A–D and Examples 1–6 had a surface area of 76 m$^2$/g. Comparative Showings A and B and Examples 1–3 constitute a series of experiments where $Nb_2O_5$ content was varied but other constituents were held constant, and illustrate the dependence of TCR on $Nb_2O_5$ content. These low resistivity resistors (about 100 ohms/square) exhibit optimum TCR characteristics at 0.4% $Nb_2O_5$ in the composition. Both the composition of Showing A ($Nb_2O_5$-free) and Showing B (1.0% $Nb_2O_5$) produced inferior TCR characteristics. Good CVR and TCR was found in Examples 1–3.

Comparative Showings C and D and Examples 4–6 illustrate resistors with resistivities an order of magnitude greater than in the previous experiments. Here again the $Nb_2O_5$-free composition (Showing C) and the composition with 1% $Nb_2O_5$ (Showing D) produced inferior results. The composition with 0.6% $Nb_2O_5$ produced the best TCR results at these higher resistivities.

Example 7 shows an even higher resistivity (100,000 ohms/square) and shows excellent TCR and CVR characteristics at 0.3% $Nb_2O_5$.

Examples 8–11 (Table 3) indicate the reduced dependence of resistivity on resistor dimensions using the preferred $CaF_2$-containing compositions of this invention. $RuO_2$ of two different surface areas was used, as indicated in Table 3.

TABLE 1

GLASSES AND IN TABLES 2, 3 AND 5

| Component | Glass (Wt. %) A | B | C |
|---|---|---|---|
| PbO | 49.4 | 37.5 | 44.5 |
| $B_2O_3$ | 13.9 | 19.2 | 11.3 |
| $SiO_2$ | 24.8 | 22.3 | 24.4 |
| $MnO_2$ | 7.9 | — | — |
| $Al_2O_3$ | 4.0 | 4.8 | 4.5 |
| ZnO | — | 10.8 | 10.2 |
| $ZrO_2$ | — | 3.6 | 4.3 |
| CuO | — | 1.8 | 0.8 |
| Surface Area (m$^2$/g) | 7.5 | 7.0 | 6.6 |

TABLE 2

| Components/ Properties | Example (No.) or Comparative Showing (Letter) | | | | | | | | | | |
|---|---|---|---|---|---|---|---|---|---|---|---|
| | A | 1 | 2 | 3 | B | C | 4 | 5 | 6 | D | 7 |
| Composition (wt. %) | | | | | | | | | | | |
| $RuO_2$ | 20 | 20 | 20 | 20 | 20 | 6 | 6 | 6 | 6 | 6 | 4.3 |
| Glass A | 23.75 | 23.75 | 23.75 | 23.75 | 23.75 | — | — | — | — | — | — |
| Glass B | 23.75 | 23.75 | 23.75 | 23.75 | 23.75 | 31 | 31 | 31 | 31 | 31 | 31.8 |
| Glass C | — | — | — | — | — | 31 | 31 | 31 | 31 | 31 | 31.8 |
| $CaF_2$ | 2 | 2 | 2 | 2 | 2 | 2 | 2 | 2 | 2 | 2 | 2 |
| $Nb_2O_5$ | — | 0.4 | 0.6 | 0.8 | 1.0 | — | 0.4 | 0.6 | 0.8 | 1.0 | 0.3 |
| Vehicle | 30.5 | 30.1 | 29.9 | 29.7 | 29.5 | 30.0 | 29.6 | 29.4 | 29.2 | 29.0 | 29.8 |
| Properties | | | | | | | | | | | |
| Resistivity (ohm/sq.) 0.5 mil thick | 51 | 91 | 128 | 157 | 202 | 3.9K* | 4.7K | 8.2K | 10.7K | 14.3K | 101.K |
| TCR (ppm/° C) −55 to +25° C. | +285 | +47 | −68 | +142 | −240 | +250 | +130 | −12 | −117 | −199 | +14 |
| +25 to +125° C. | +255 | +6 | −136 | −223 | −338 | +240 | +111 | −42 | −164 | −269 | +45 |
| ΔTCR | 30 | 41 | 68 | 81 | 98 | 10 | 19 | 30 | 47 | 70 | 31 |
| CVR (%) | 2 | 4 | 6 | 5 | 6 | 5 | 5 | 2 | 3 | 3 | 2 |

*K means 1000

TABLE 3

| Components/ Properties | Example No. | | | |
|---|---|---|---|---|
| | 8 | 9 | 10 | 11 |
| Composition (wt. %) | | | | |
| $RuO_2$ (80m²/g) | 6.9 | 6.0 | — | — |
| $RuO_2$ (68m²/g) | — | — | 7 | 6.6 |
| Glass B | 22.2 | 21.9 | 22.2 | 21.7 |
| Glass C | 40.4 | 39.6 | 40.4 | 39.7 |
| $CaF_2$ | — | 2 | — | 2 |
| $Nb_2O_5$ | 0.5 | 0.5 | 0.4 | 0.4 |
| Vehicle | 30 | 30 | 30 | 29.6 |
| Resistivity (ohms/sq.) for resistors of the following dimensions (length × width) | | | | |
| 4mm × 1mm | 10.5K | 10.0K | 10.7K | 8.2K |
| 2mm × 1mm | 9.4K | 9.4K | 10.0K | 7.9K |
| 1mm × 1mm | 8.3K | 8.9K | 9.4K | 7.9K |
| TCR (ppm/° C.) +25 to +125° C. | +7 | +73 | +50 | +84 |

Comparative Showings E, F and G in Table 4 illustrate the importance of using the PbO glass and $Nb_2O_5$ powder of this invention. In these showings $RuO_2$ (68m²/g) and a $Bi_2O_3$ glass (50.4% $Bi_2O_3$, 3.3% PbO, 9.2% $B_2O_3$, 32.8% $SiO_2$, 4.3% $SiO_2$) were used, resulting in poor CVR characteristics.

TABLE 4

| | Showing | | |
|---|---|---|---|
| | E | F | G |
| Composition (wt.%) | | | |
| $RuO_2$ | 10 | 12 | 14 |
| Glass | 60 | 58 | 56 |
| Vehicle | 30 | 30 | 30 |
| Properties | | | |
| Resistivity (ohms/sq.) | 11.7K | 2.2K | 0.63K |
| CVR (%) | 11.6 | 17.7 | 17 |
| TCR (ppm/° C.) +25 to +125° C. | −20 | +52 | — |

Comparative Showings H, I and J (Table 5) illustrate the importance of $Nb_2O_5$ in this invention. $RuO_2$ (80m²/g) and PbO glass produced poor hot TCR characteristics, greater than 300 ppm/° C., when no $Nb_2O_5$ was used.

TABLE 5

| | Showing | | |
|---|---|---|---|
| | H | I | J |
| Composition (wt.%) | | | |

TABLE 5-continued

| | Showing | | |
|---|---|---|---|
| | H | I | J |
| $RuO_2$ | 6 | 6 | 6 |
| Glass B | 35.2 | 31 | 24.8 |
| Glass C | 24.8 | 31 | 35.2 |
| $CaF_2$ | 2 | 2 | 2 |
| Vehicle | 30 | 30 | 30 |
| Properties | | | |
| Resistivity (ohms/sq.) | 9.98K | 15.2K | 12.2K |
| CVR (%) | 3.6 | 2.1 | 4.6 |
| TCR(ppm/° C.) +25 to +125° C. | +344 | +308 | +310 |

I claim:

1. Printable compositions of finely divided inorganic powder dispersed in an inert liquid vehicle for producing film resistors adherent to a dielectric substrate, the compositions consisting essentially of, by weight, a dispersion of
(1) 2–45% finely divided $RuO_2$ powder
(2) 40–70% glass comprising 30–55% PbO,
(3) 0.1–0.8% $Nb_2O_5$,
(4) 0–5% $CaF_2$, and
(5) 15–40% inert vehicle.

2. Compositions according to claim 1 of
(1) 3–30% $RuO_2$,
(2) 45–65% glass,
(3) 0.2–0.7% $Nb_2O_5$,
(4) 0–5% $CaF_2$ and
(5) 20–40% vehicle.

3. Compositions according to claim 2 wherein glass (2) comprises 40–45% PbO.

4. Compositions according to claim 2 wherein (4) is 1–3% $CaF_2$.

5. Compositions according to claim 3 wherein (4) is 1–3% $CaF_2$.

6. Compositions according to claim 2 of
(1) 4–20% $RuO_2$,
(2) 47–62% of a glass comprising 40–45% PbO,
(3) 0.2–0.7% $Nb_2O_5$,
(4) 1–3% $CaF_2$, and
(5) 20–40% vehicle.

7. Dielectric substrates having adherent thereto sintered film resistors of the composition of claim 1.

8. Dielectric substrates having adherent thereto sintered film resistors of the composition of claim 2.

9. Dielectric substrates having adherent thereto sintered film resistors of the composition of claim 3.

10. Dielectric substrates having adherent thereto sintered film resistors of the composition of claim 6.

* * * * *